US010116095B1

(12) United States Patent
Sundarakrishnamachari et al.

(10) Patent No.: US 10,116,095 B1
(45) Date of Patent: Oct. 30, 2018

(54) ELECTRICAL CONNECTOR WITH POSITION ASSURANCE DEVICE

(71) Applicant: Delphi Technologies, Inc., Troy, MI (US)

(72) Inventors: Rangarajan Sundarakrishnamachari, Chennai (IN); Sudhakar Subramanian, Tamil Nadu (IN); Sivakumar Niranjan, Tamil Nadu (IN); John Schneider, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/794,612

(22) Filed: Oct. 26, 2017

(51) Int. Cl.
*H01R 13/641* (2006.01)
*H01R 13/627* (2006.01)

(52) U.S. Cl.
CPC ..... *H01R 13/641* (2013.01); *H01R 13/6273* (2013.01)

(58) Field of Classification Search
CPC . H01R 13/506; H01R 13/641; H01R 13/6273
USPC ..... 439/488, 489, 352, 353, 315, 157
See application file for complete search history.

(56) References Cited

U.S. PATENT DOCUMENTS 5,775,930 A 7/1998 Model et al.
5,947,763 A 9/1999 Alaksin
6,068,507 A * 5/2000 Popa ..... H01R 13/641 439/352
7,470,138 B1 * 12/2008 Chen ..... H01R 13/506 439/352
8,016,606 B1 * 9/2011 Kwan ..... H01R 13/641 439/352
8,277,243 B1 * 10/2012 Hernandez ..... H01R 13/4362 439/352
8,784,127 B2 7/2014 Bashkin et al.
9,362,676 B2 * 6/2016 Puhl ..... H01R 13/6273
9,680,256 B1 * 6/2017 Lane ..... H01R 13/6275
2003/0096527 A1 * 5/2003 Greiner ..... H01R 13/6272 439/352
2009/0035981 A1 * 2/2009 Lim ..... H01R 13/4361 439/352

(Continued)

*Primary Examiner* — Michael A Lyons
*Assistant Examiner* — Milagros Jeancharles
(74) *Attorney, Agent, or Firm* — Robert J. Myers

(57) ABSTRACT

An electrical connector includes a first-housing, a second-housing, and a connector-position-assurance (CPA) device. The first-housing has two parallel actuation-ribs extending from an outer-surface of the first-housing. The actuation-ribs are aligned parallel to a longitudinal mating-axis of the electrical connector. The second-housing is configured to mate with the first-housing and includes two opposing lugs projecting from a top-surface of the second-housing. The CPA device is slideably mounted to the second-housing and is moveable from a pre-stage-position to a latched-position. The CPA device includes two parallel latching-arms that engage the lugs. The latching-arms are in a relaxed-state when in the pre-stage-position. The actuation-ribs disengage the latching-arms from the lugs when the first-housing is mated with the second-housing. This enables the CPA device to be moved from the pre-stage-position to the latched-position. The latching-arms return to the relaxed-state when in the CPA device is in the latched-position.

6 Claims, 4 Drawing Sheets

(56) References Cited

U.S. PATENT DOCUMENTS

2015/0295357 A1* 10/2015 Campbell ..... H01R 13/6272
439/352

* cited by examiner

ELECTRICAL CONNECTOR WITH POSITION ASSURANCE DEVICE

TECHNICAL FIELD OF INVENTION

This disclosure generally relates to an electrical connector, and more particularly relates to an electrical connector having a connector-position-assurance (CPA) device.

BACKGROUND OF INVENTION

It is known to use a connector-position-assurance (CPA) device to assure that an electrical connector is mated properly, and to prevent the electrical connector from inadvertent separation during use. Prior art CPA devices may be inadvertently moved into a locked position before the electrical connector is mated and prevent the mating operation from occurring. These CPA devices may also fail due to the interference and lead to increased scrap rates. Other prior art CPA devices are separate from the electrical connector and may present ergonomic challenges for an assembler.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

In accordance with one embodiment, an electrical connector is provided. The electrical connector includes a first-housing, a second-housing, and a connector-position-assurance (CPA) device. The first-housing has two parallel actuation-ribs extending from an outer-surface of the first-housing. The two parallel actuation-ribs are aligned parallel to a longitudinal mating-axis of the electrical connector. The second-housing is configured to mate with the first-housing and includes two opposing lugs projecting from a top-surface of the second-housing. The CPA device is slideably mounted to the second-housing and is moveable along the longitudinal mating-axis from a pre-stage-position to a latched-position. The CPA device includes two parallel latching-arms that engage the two opposing lugs at distal-ends of the two parallel latching-arms such that a movement of the CPA device is inhibited in the pre-stage-position. The two parallel latching-arms are in a relaxed-state when in the pre-stage-position. The two parallel actuation-ribs of the first-housing move beyond the two opposing lugs of the second-housing and disengage the two parallel latching-arms from the two opposing lugs by flexing the two parallel latching-arms into a stressed-state when the first-housing is mated with the second-housing. This enables the CPA device to be moved from the pre-stage-position to the latched-position. The two parallel latching-arms return to the relaxed-state when in the CPA device is in the latched-position.

The CPA device further includes locking-ribs extending from an upper-surface of the CPA device. The locking-ribs are configured to inhibit an actuation of an axial connector-lock when the CPA device is in the latched-position. A vibratory-feedback from the two parallel latching-arms is provided to an assembler indicative of a properly mated connector when the CPA device is moved to the latched-position.

The two parallel latching-arms deflect in a lateral-direction orthogonal to the longitudinal mating-axis when the two parallel actuation-ribs disengage the two parallel latching-arms. The two parallel latching-arms move in a medial-direction. The distal-ends of the of the two parallel latching-arms are characterized as having a C-shape. A distance between the distal-ends of the two parallel latching-arms is greater than a width of a body of the CPA device when the two parallel latching-arms are in the relaxed-state.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Described herein is an electrical connector with an integrated connector-position-assurance (CPA) device. The CPA device is configured to be moved from a pre-stage-position into a latched position indicative of a properly mated electrical connector. The CPA device is securely retained on one of the mating connectors and is inhibited from movement from the pre-stage-position until the electrical connector is properly mated.

Figure 1:
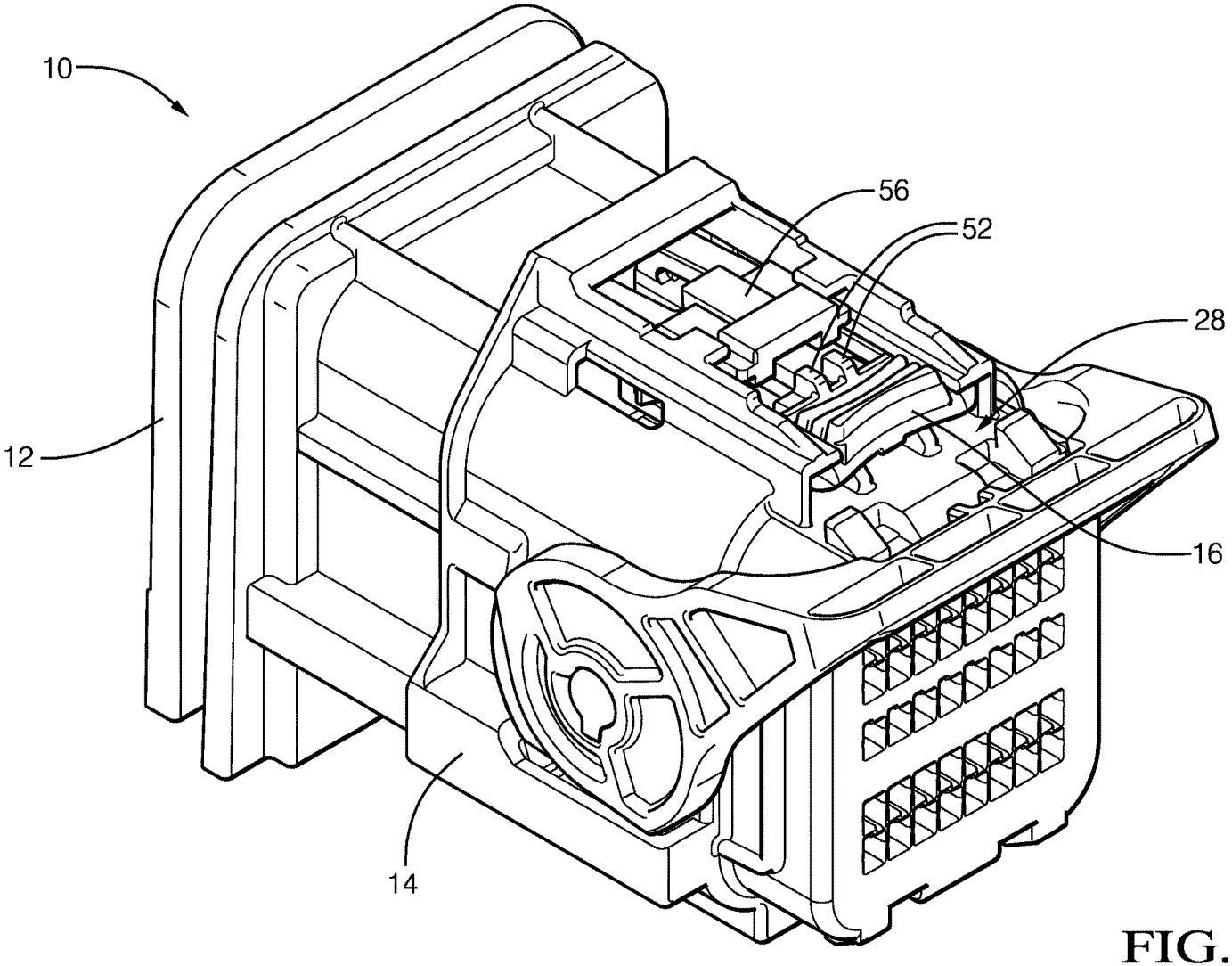
FIG. 1 is an illustration of an electrical connector with a CPA device in accordance with one embodiment.

FIG. 1 illustrates a non-limiting example of an electrical connector 10. The electrical connector 10 includes a first-housing 12, a second-housing 14 configured to mate with the first-housing 12, and a connector-position-assurance (CPA) device 16. The first-housing 12 and the second-housing 14 may include electrical-terminals that mate with one another (not shown). The electrical-terminals may be attached to electrical-cables (not shown) that connect to an electrical system of a vehicle.

Figure 2:
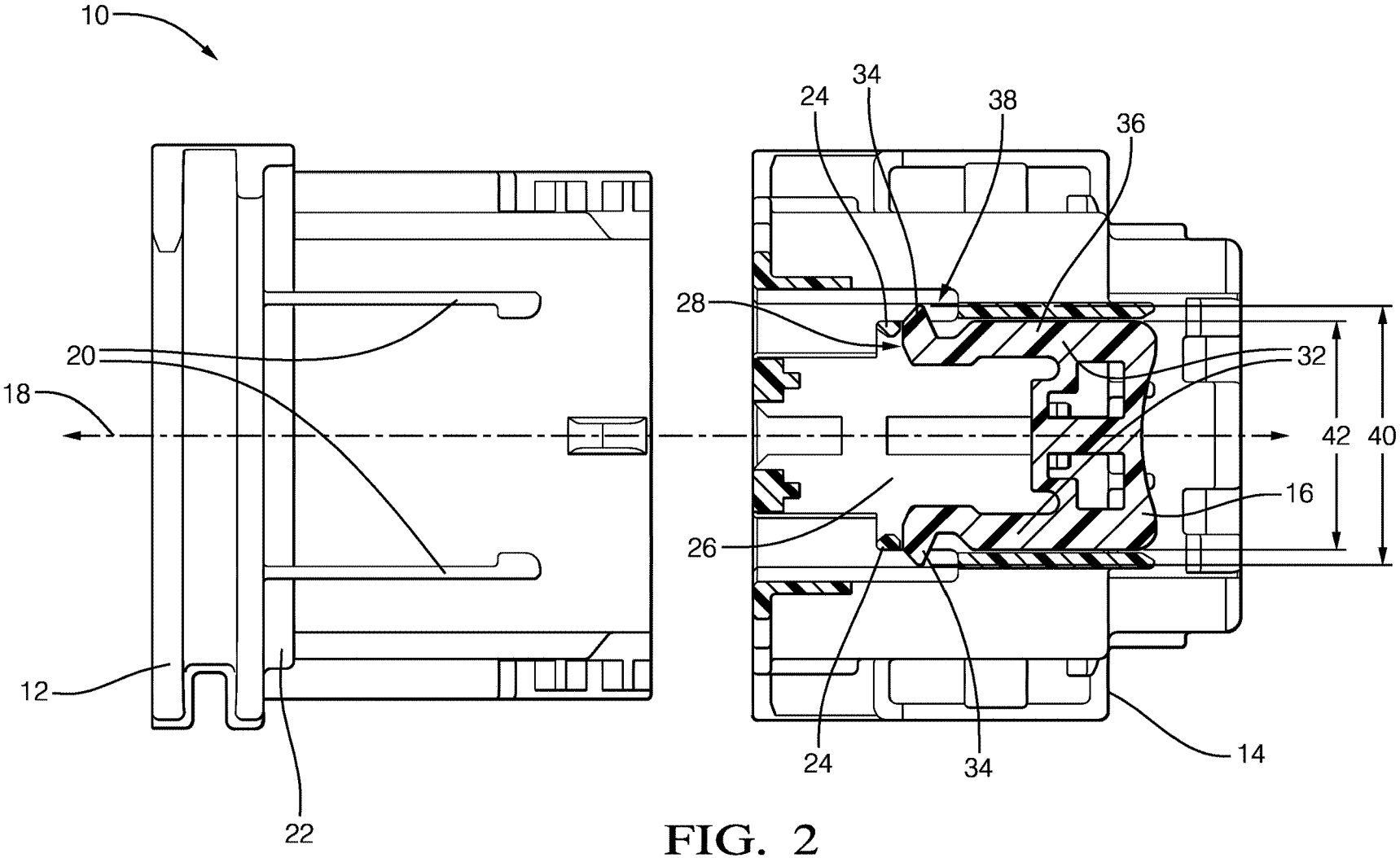
FIG. 2 is an illustration of the electrical connector of FIG. 1 in an un-mated condition in accordance with one embodiment.

FIG. 2 illustrates the electrical connector 10 in an un-mated condition to more clearly present the features. The first-housing 12 and the second-housing 14 are aligned along a longitudinal mating-axis 18 and are positioned to be mated. The first-housing 12 has two parallel actuation-ribs 20 extending from an outer-surface 22 of the first-housing 12. The two parallel actuation-ribs 20 are aligned parallel to the longitudinal mating-axis 18 of the electrical connector 10, as illustrated in FIG. 2. The two parallel actuation-ribs 20 are configured to engage slots formed in the second-housing 14 that guide the two parallel actuation-ribs 20 during the mating operation.

The second-housing 14 includes two opposing lugs 24 projecting from a top-surface 26 of the second-housing 14. The two opposing lugs 24 are positioned medially relative to the two parallel actuation-ribs 20 (i.e. closer to the longitudinal mating-axis 18) and provide a second guide surface to the two parallel actuation-ribs 20 during the mating operation.

Figure 3A:
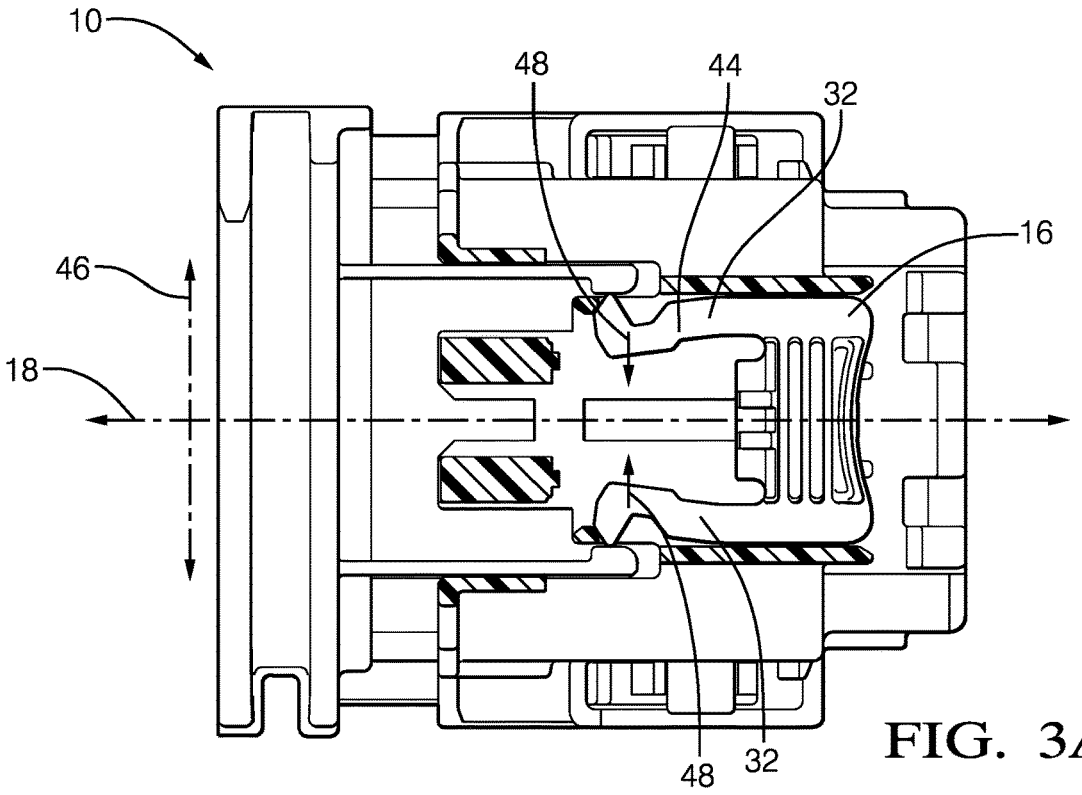
FIG. 3A is an illustration of the CPA device in a disengaged condition in accordance with one embodiment.
Figure 3B:
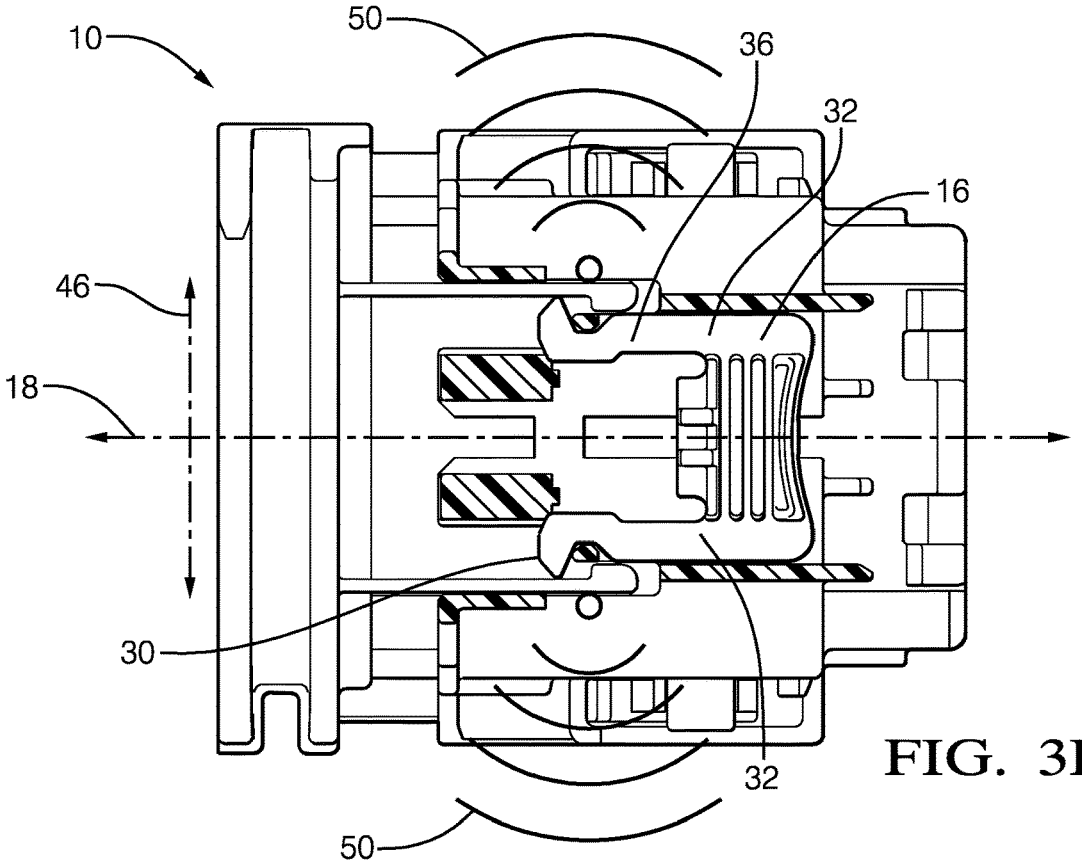
FIG. 3B is an illustration of the CPA device of FIG. 3A in a latched-position in accordance with one embodiment.

The CPA device 16 is slideably mounted to the second-housing 14 and moveable along the longitudinal mating-axis 18 from a pre-stage-position 28 to a latched-position 30 (see FIG. 3B). The CPA device 16 includes two parallel latching-arms 32 that engage the two opposing lugs 24 at distal-ends 34 of the two parallel latching-arms 32. At least the two parallel latching-arms 32 of the CPA device 16 are formed of a flexible polymeric compound. This engagement creates a positive stop such that a movement of the CPA device 16 is inhibited in the pre-stage-position 28. The CPA device 16 is inhibited from removal from the second-housing 14 by locking features molded into the second-housing 14 (not specifically shown). The two parallel latching-arms 32 are shown in FIG. 2 as being in a relaxed-state 36 when in the pre-stage-position 28. That is, there is no bending-strain within the CPA device 16 in the pre-stage-position 28. The relaxed-state 36 is beneficial to prevent plastic deformation from occurring in the two parallel latching-arms 32. The distal-ends 34 of the of the two parallel latching-arms 32 may be characterized as having a C-shape 38. The C-shape 38 may be angulated or rounded based on manufacturing preferences. A distance 40 between the distal-ends 34 of the two parallel latching-arms 32 is greater than a width 42 of a body of the CPA device 16 when the two parallel latching-arms 32 are in the relaxed-state 36, as illustrated in FIG. 2.

FIGS. 3A-3B illustrate the electrical connector 10 in the mated-position and illustrate the progression of the movement of the CPA device 16. FIG. 3A shows the two parallel actuation-ribs 20 of the first-housing 12 moved beyond the two opposing lugs 24 of the second-housing 14 to disengage the two parallel latching-arms 32 from the two opposing lugs 24. The disengagement occurs by flexing the two parallel latching-arms 32 into a stressed-state 44 (i.e. bending-strain is induced within the CPA device 16) when the first-housing 12 is mated with the second-housing 14. The two parallel latching-arms 32 deflect in a lateral-direction 46 orthogonal to the longitudinal mating-axis 18 when the two parallel actuation-ribs 20 disengage the two parallel latching-arms 32. That is, the two parallel latching-arms 32 move in a medial-direction 48 (i.e. toward the longitudinal mating-axis 18) when disengaged, as illustrated in FIG. 3A.

As illustrated in FIG. 3B, the disengagement of the two parallel latching-arms 32 enables the CPA device 16 to be moved from the pre-stage-position 28 to the latched-position 30 where the two parallel latching-arms 32 return to the relaxed-state 36. A vibratory-feedback 50 from the two parallel latching-arms 32 sliding past the two opposing lugs 24 may be provided to an assembler indicative of a properly mated electrical connector 10 when the CPA device 16 is moved to the latched-position 30.

Figure 4:
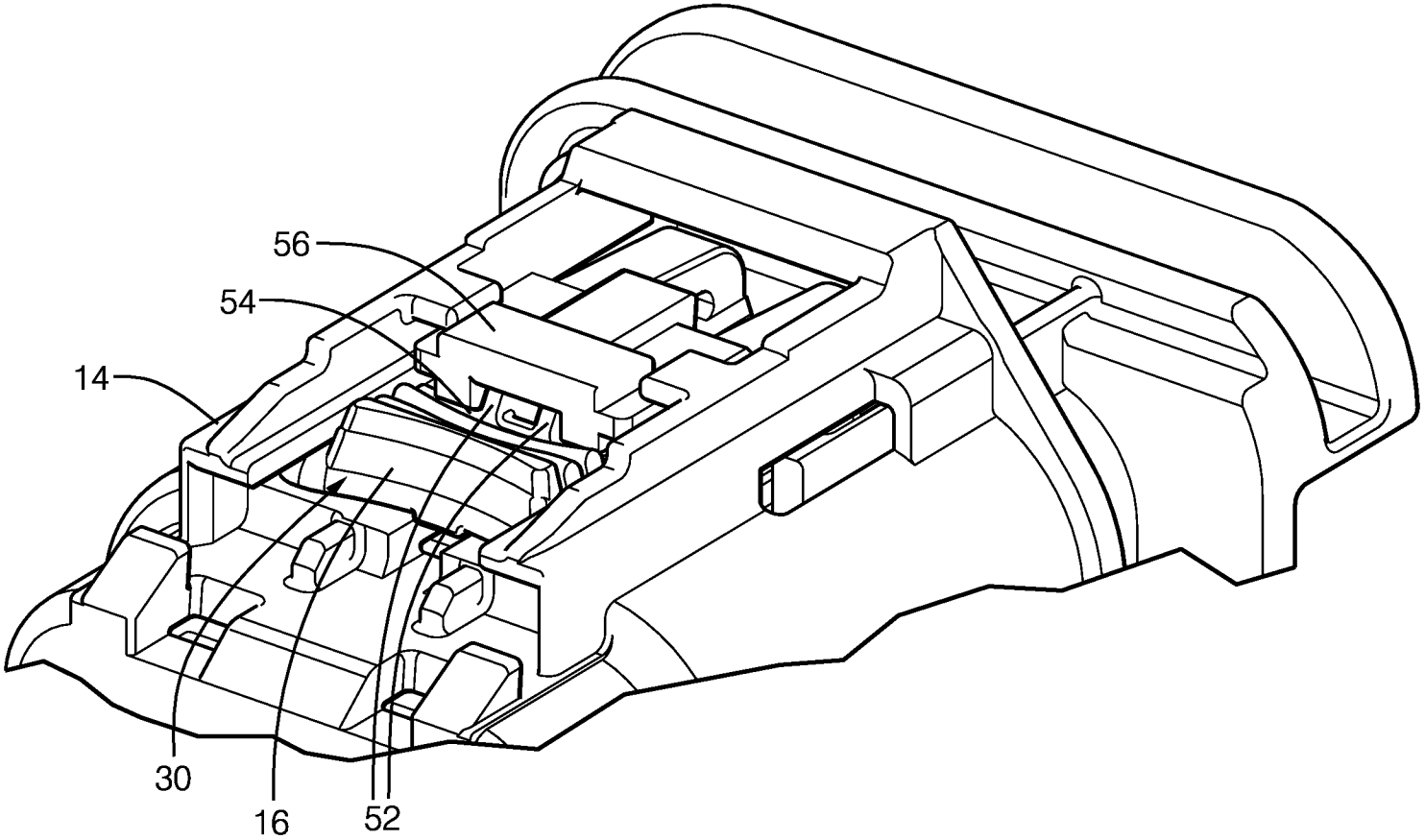
FIG. 4 is an illustration of the CPA device in the latched-position supporting an axial connector-lock in accordance with one embodiment.

FIG. 4 is an enlarged view of the second-housing 14 with the CPA device 16 in the latched-position 30. The CPA device 16 may include locking-ribs 52 extending from an upper-surface 54 of the CPA device 16 that are configured to inhibit an actuation of an axial connector-lock 56. In the specific example of the electrical connector 10 illustrated in FIG. 4, the locking-ribs 52 support the axial connector-lock 56 such that the axial connector-lock 56 may not be depressed to release the second-housing 14 from the first-housing 12.

Accordingly, an electrical connector 10 with a CPA device 16 is provided. The electrical connector 10 is an improvement over other electrical connectors because the CPA device 16 has two parallel latching-arms 32 that return to the relaxed-state 36 when the CPA device 16 is moved to the latched-position 30.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector, comprising;

a first-housing having two parallel actuation-ribs extending from an outer-surface of the first-housing, said two parallel actuation-ribs aligned parallel to a longitudinal mating-axis of the electrical connector;

a second-housing configured to mate with the first-housing, said second-housing includes two opposing lugs projecting from a top-surface of the second-housing; and a connector-position-assurance (CPA) device, said CPA device slideably mounted to the second-housing and moveable along the longitudinal mating-axis from a pre-stage-position to a latched-position, said CPA device includes two parallel latching-arms that engage the two opposing lugs at distal-ends of the two parallel latching-arms such that a movement of the CPA device is inhibited in the pre-stage-position, wherein the two parallel latching-arms are in a relaxed-state when in said pre-stage-position, wherein the two parallel actuation-ribs of the first-housing move beyond the two opposing lugs of the second-housing and disengage the two parallel latching-arms from the two opposing lugs by flexing the two parallel latching-arms into a stressed-state when the first-housing is mated with the second-housing, thereby enabling the CPA device to be moved from the pre-stage-position to the latched-position, and wherein the two parallel latching-arms return to the relaxed-state when in the CPA device is in the latched-position, wherein the CPA device further includes locking-ribs extending from an upper-surface of the CPA device, wherein the locking-ribs are configured to inhibit an actuation of an axial connector-lock when the CPA device is in the latched-position.

2. The electrical connector in accordance with claim 1, wherein a vibratory-feedback from the two parallel latching-arms is provided to an assembler indicative of a properly mated connector when the CPA device is moved to the latched-position.

3. The electrical connector in accordance with claim 1, wherein the two parallel latching-arms deflect in a lateral-direction orthogonal to the longitudinal mating-axis when the two parallel actuation-ribs disengage the two parallel latching-arms.

4. The electrical connector in accordance with claim 3, wherein the two parallel latching-arms move in a medial-direction.

5. The electrical connector in accordance with claim 1, wherein the distal-ends of the of the two parallel latching-arms are characterized as having a C-shape.

6. The electrical connector in accordance with claim 1, wherein a distance between the distal-ends of the two parallel latching-arms is greater than a width of a body of the CPA device when the two parallel latching-arms are in the relaxed-state.

* * * * *